United States Patent [19]

Clark

[11] Patent Number: 4,790,539

[45] Date of Patent: Dec. 13, 1988

[54] GOLF SWING TRAINING APPARATUS

[76] Inventor: Richard Clark, 5885 N. Washington Rd., Piqua, Ohio 45356

[21] Appl. No.: 135,201

[22] Filed: Dec. 21, 1987

[51] Int. Cl.[4] ..... A63B 69/36

[52] U.S. Cl. ..... 273/190 B; 2/425

[58] Field of Search ..... 273/190 R, 190 A, 190 B, 273/190 C, 183 B, 188 R, 26 C, 29 A; 2/10, 425, 422

[56] References Cited

U.S. PATENT DOCUMENTS 1,668,023 5/1928 Murphy ..... 273/190 B 3,729,200 4/1973 Hines et al. ..... 273/183 B 4,098,509 7/1978 Van Krevelen ..... 273/183 B

*Primary Examiner*—George J. Marlo

*Attorney, Agent, or Firm*—Biebel, French & Nauman

[57] ABSTRACT

The invention is concerned with an apparatus for use in perfecting a golfer's stroke by aiding the golfer in preventing undesirable head movement. The apparatus includes a headpiece with a visor to which a bracket is mounted. A retaining pin is inserted into the bracket and is connected to the bracket by a cord which is of a length sufficient to allow the pin to be removed from the headpiece, inserted into the ground in front of the golfer and positioned so that the cord is in a taut condition, thus restraining the head of the golfer.

7 Claims, 2 Drawing Sheets

GOLF SWING TRAINING APPARATUS

BACKGROUND OF THE INVENTION

The present invention relates to a golf training apparatus, and, in particular, to a golf training apparatus designed to restrain a golfer's head movement during his swing.

It is a common practice among golfers to use training devices in order to perfect their stance and/or their swing. Some of these devices are part of equipment available for use at driving ranges or on the golf course and some are portable units which are owned by golfers and are used in small areas such as a home or an office.

In order to have proper contact with a golf ball when swinging a golf club, the golfer's head must be substantially immobile. Head movement will cause the golfer to improperly move other portions of his body, thus preventing the golf club from making proper contact with the golf ball.

Undesirable head movement during a golf swing is difficult to detect. Since the golfer must coordinate all of his body movements while maintaining his head immobility, it is difficult to detect head movement and such movement is difficult to overcome.

Most of the presently available devices seek to enhance the control of head movement through means which such devices are shown in U.S. Pat. Nos. 1,569,766, 1,668,023, 4,098,509 and 4,560,166, all of which disclose an audible signalling device; U.S. Pat. Nos. 4,303,244, 3,729,200, 2,461,826 and 2,077,318 all of which disclose a visual signalling device; and U.S. Pat. No. 1,640,765 which discloses a locking device. None of the presently available devices, however, provide for correcting head movement of a golfer by concentrating in particular on restraining the golfer's head to resist head movement from back to front or from side to side during an ensuing golf swing. Additionally, the presently available devices are awkward or complex mechanisms which are not practical for use on a golf course.

It is the opinion of many golfers that proper control of head movement during the golfer's swing will contribute much toward the improvement of a golfer's skill in the game of golf. Thus, it would be an advantage for golfers to have access to a device which restrains head movement without any complicated activity on the part of the golfer. What is needed, therefore, is a simple and inexpensive device which will help a golfer improve his overall swing by concentrating on restraining the movement of the golfer's head to resist the head from moving from back to front or from side to side during the golfer's swing.

SUMMARY OF THE INVENTION

The present invention discloses a golf training apparatus for use in restraining proper head movement. The apparatus includes a headpiece which has a headband surrounding the golfer's head at approximately the forehead level. A bracket is mounted on the headpiece, for example on a visor of the headpiece, and a retaining pin is supported in the bracket with a flexible cord connecting the bracket to the pin. The cord has a length sufficient to allow the pin to be removed from the headpiece so that it may be inserted into the ground in front of the golfer.

Preferably, the cord which connects the bracket and the pin is constructed of a flexible, non-stretchable material. The cord has a loop at each end with one of the loops secured to the bracket and the other loop secured to the pin.

Before the golfer is ready to address the ball, he will remove the pin from the bracket and insert it into the ground in front of his feet at a point beyond the golf ball and beyond the path of the golf club. The golfer will then adjust the length of the cord so that the cord is in a taut condition when the golfer stands addressing the ball, his head tilted down and his eyes directly looking at the ball, thereby restraining the golfer's head against movement from back to front or from side to side during his ensuing swing.

This device may be used by a golfer when driving a ball and may be used when the golfer is using an iron or when he is using a wood. The device may be used with any headpiece, but preferable a headpiece that has a visor, with the bracket attached to the visor, as by rivets. The pin may be easily inserted into the bracket and easily removed for insertion into the ground.

The primary object of this invention is to provide for a golfer a device, and a method of using such device, which will help to perfect his golf swing by restraining his head movement during the swing and to provide such a device that is simple to use and that is easily transported from place to place.

Other objects and advantages of the invention will be apparent from the following description, the accompanying drawings and the appended claims.

DETAILED DESCRIPTION OF PREFERRED EMBODIMENT

Figure 1:
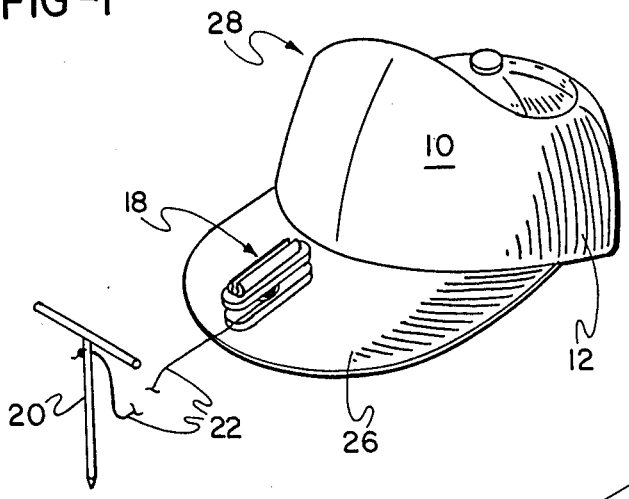
FIG. 1 is a top view of the training apparatus showing the bracket positioned on the visor of a golfer's hat.
Figure 4:
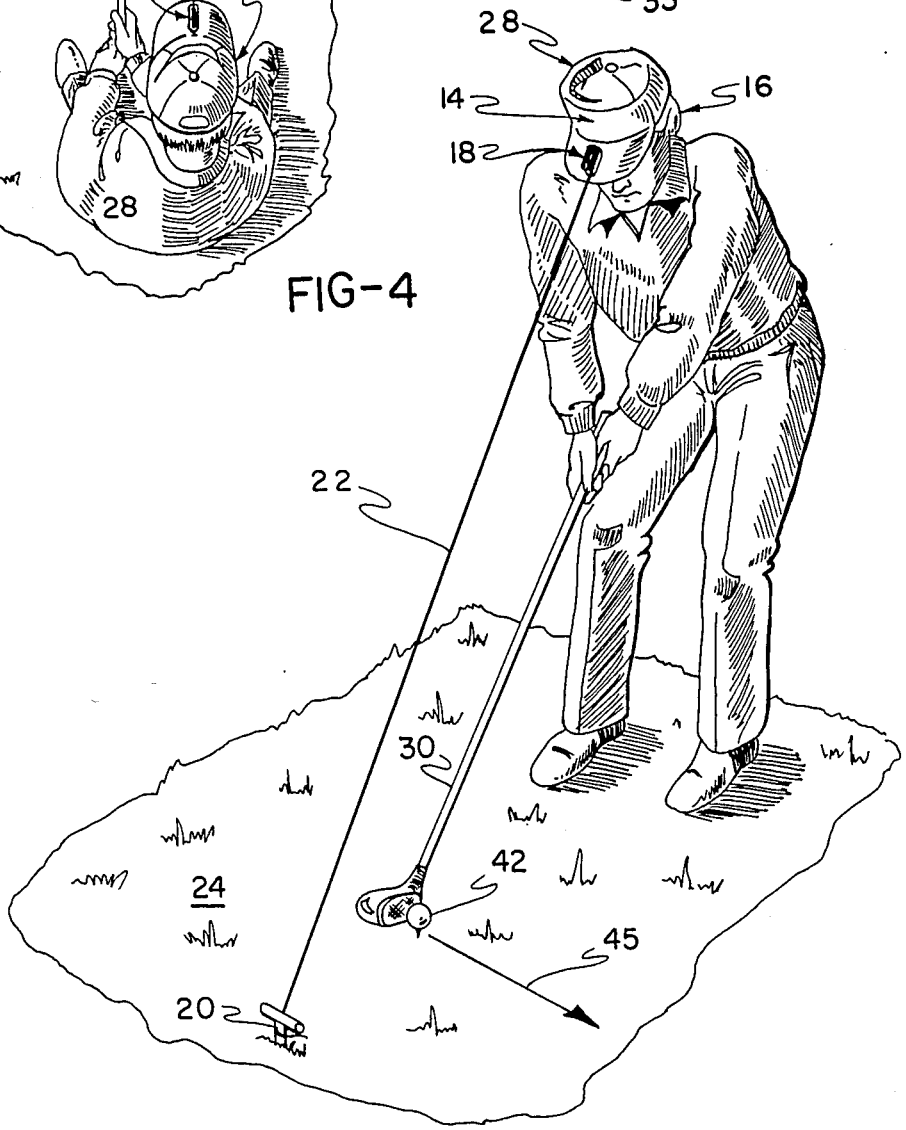
FIG. 4 is an elevational view showing the position of the various elements of the apparatus when in use.

As shown in FIGS. 1 and 4, the golf swing training apparatus includes a headpiece 10 with a head band 12 which is worn at the forehead 14 level of the golfer's head 16. A bracket 18 is positioned on the head piece 10 and a retaining pin 20 is inserted into the bracket 18. A flexible cord 22 connects the bracket 18 to the pin 20 and the cord 22 is long enough that the pin 20 may be removed from the bracket 18 and inserted into the ground 24 in front of the golfer on the opposite side of the ball, as shown in FIG. 4.

Figure 5:
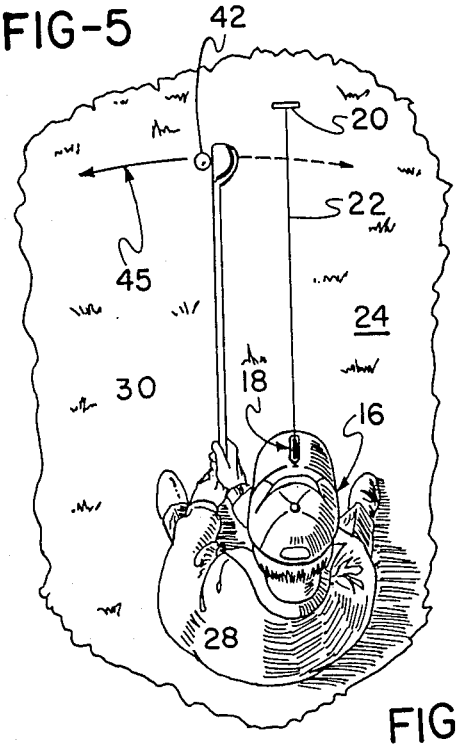
FIG. 5 is a top view showing the path of the golf club in respect to the training apparatus.

As shown in FIG. 5, the cord 22 is adjusted lengthwise when the pin 20 is inserted into the ground 24 so the cord 22 remains in a taut condition. Thus the cord 22 restrains the golfer's head 16 to resist head movement from back to front or from side to side when the golfer swings his club 30, as shown in FIG. 5.

FIG. 1 shows bracket 18 positioned on the visor 26 of a cap 28, which customarily includes a head band from which the visor extends. The bracket 18 may also be connected to a visor which is part of an eyeshade-type headpiece, rather than a hat.

Figure 2:
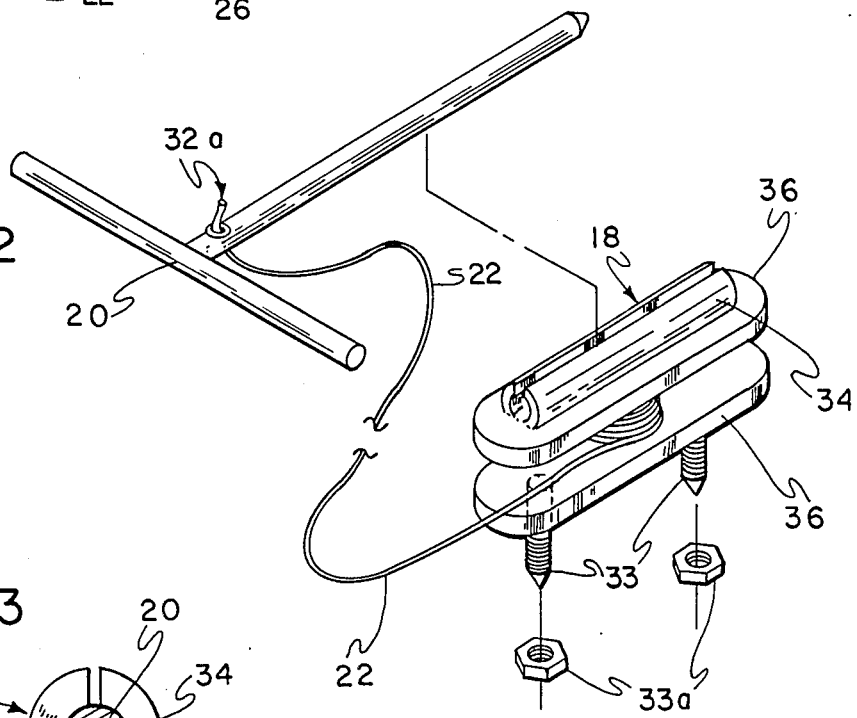
FIG. 2 is a perspective view of the retaining pin and the bracket of the training apparatus.
Figure 3:
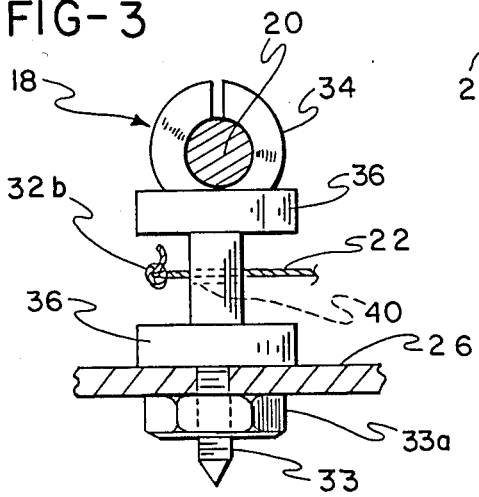
FIG. 3 is an end view of the bracket.

The cord 22 is attached to the pin 20 and the bracket 18 by means of loops 32, as shown in FIGS. 2 and 3.

One end loop 32*a* is attached to the pin 20 as shown in FIG. 2, and the other end loop 32*b* is attached to the bracket 18, as shown in FIG. 3. The cord 22 is made of a flexible, nonstretchable material such as cotton twine. The retaining pin 20 and the bracket 18 are made of a lightweight material such as plastic or lightweight metal. Bracket 20 may be secured to visor 26 by threaded pins 33 and cooperating nuts 33*a* permanently attached to a visor using such means as rivets.

Figure 6:
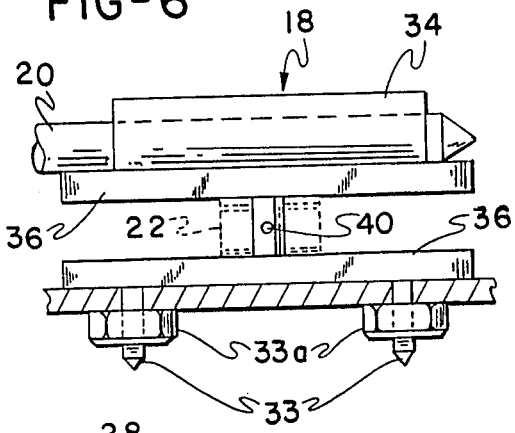
FIG. 6 is a side view of the bracket with the retaining pin inserted inside the bracket.

The bracket 18 includes a longitudinally split cylindrical shaped tube 34 on top of the bracket, as shown in FIG. 2. The pin 20 is pressed into the slightly small opening in tube 34 when not in use, as shown in FIG. 6. The bracket 18, as shown in FIGS. 2 and 3, has two rectangular pieces 36 underneath the tube 34 which are connected by a short stud 38 containing a hole 40 in its middle. One loop 32*a* end of the cord 22 is inserted through this hole 40 and tied off to secure the cord 22 to the bracket 18 as shown in FIG. 3.

In operation, the golfer, when ready to address a golf ball 42, will remove the pin 20 from the bracket 18 and will insert the pin 20 into the ground 24 directly in front of the golfer and on the opposite side of the ball 42 which the golfer intends to hit. The golfer will then adjust the length of the cord 22 so the cord 22 is retained in a taut condition when the golfer stands addressing the ball 42 with his head tilted forward and down, eyes directly on the ball. Cord 22 will restrain the golfer's head 16 so as to resist head movement from back to front or from side to side during the ensuing swing of the golf club 30. As shown in FIG. 5, the head 16 remains immobile when the apparatus is correctly positioned in the ground 24.

The golf training apparatus described is relatively simple and can be adapted to one's favorite headpiece or manufactured in combination with a headpiece which would be specifically constructed for this apparatus. The device is sufficiently simple and practical that the golfer may use it during his actual game of golf or in private practice sessions, making multiple practice swings and therefore forming the proper head position habit. The device can be used with either woods or irons and is equally useful for either left-handed or right-handed golfers.

This training apparatus is best used on a practice range or a golf course, but can also be used in a yard, or indoors with special practice balls. When the device is used on an actual course or on a driving range, using normal golf balls, it provides to the user a form of alignment. By adjusting his address location, the golfer can locate the taut cord in a plane perpendicular to the desired flight path 45 of the ball, as shown in FIGS. 4 and 5. Experience with the device has shown that, if the golfer swings normally while using the device, the flight path or line of the struck ball will be essentially at right angles to a vertical plane containing the taut cord.

Another advantage of this invention is that the device may be embodied in a headpiece designed for the dual purpose of golf training and advertising. Promotional or advertising material can be displayed on the visor of the headpiece or on the body of the headpiece itself, thus making the invention a promotional device which can be given to golfers or sold inexpensively.

While the method herein described, and the form of apparatus for carrying this method into effect, constitute prefered embodiments of this invention, it is to be understood that the invention is not limited to this precise method and form of apparatus, and that changes may be made in either without departing from the scope of the invention, which is defined in the appended claims.

What is claimed is:

1. A golf swing training apparatus for use in practicing proper head movement comprising:

(A) a headpiece adapted to be worn by a golfer including a head band adapted to surround the golfer's head approximately at the forehead level;

(B) a retaining pin;

(C) a bracket fixed on said headpiece and adapted to support said pin when the apparatus is not in use;

(D) a flexible cord connecting said bracket to said pin, said cord having a length sufficient to allow said pin to be removed from said headpiece and to be inserted into the ground in front of golfer and on the opposite side of a ball addressed by the golfer.

2. A golf swing training apparatus as claimed in claim 1 wherein said cord is comprised of a flexible nonstretchable material.

3. A golf swing training apparatus as claimed in claim 2 wherein said pin is T-shaped to facilitate placement and insertion thereof in the ground.

4. A golf swing training apparatus as claimed in claim 3 wherein said headpiece comprises a hat having a connected visor and said bracket is fixed to said visor.

5. A golf swing training apparatus as claimed in claim 3 wherein said headpiece comprises an eyeshade having a connected visor and said bracket is fixed to said visor.

6. A golf swing training apparatus as claimed in claim 3 wherein said cord has a loop at each end, one of said loops being adapted to be secured to said bracket and the other of said loops being adapted to be secured to said pin.

7. A method of training a golfer by restraining head movement during a swing, employing a head band adapted to be worn by the golfer, a retaining pin, a bracket fixed on said headpiece, and a cord connecting said bracket to said pin, the cord having a length sufficient to allow the pin to be inserted into the ground in front of golfer and on the opposite side of a ball the golfer is addressing, comprising the steps of:

inserting the pin into the ground in front of the golfer's feet at a point beyond the golf ball and the path of the golf club, adjusting the length of the cord so that the cord is retained in a taut condition when the golfer stands addressing the ball, thereby restraining the golfer's head to resist head movement from back to front or from side to side during an ensuing swing.

* * * * *